US012338631B1

(12) United States Patent
Paulson

(10) Patent No.: US 12,338,631 B1
(45) Date of Patent: Jun. 24, 2025

(54) DOWNSPOUT GUTTER EXTENSION DISPLACEMENT DEVICE

(71) Applicant: Trever Paulson, Kasson, MN (US)

(72) Inventor: Trever Paulson, Kasson, MN (US)

( * ) Notice: Subject to any disclaimer, the term of this patent is extended or adjusted under 35 U.S.C. 154(b) by 228 days.

(21) Appl. No.: 18/129,036

(22) Filed: Mar. 30, 2023

Related U.S. Application Data

(60) Provisional application No. 63/325,335, filed on Mar. 30, 2022.

(51) Int. Cl.
*E04D 13/08* (2006.01)

(52) U.S. Cl.
CPC ..... *E04D 13/08* (2013.01); *E04D 2013/0806* (2013.01); *E04D 2013/0833* (2013.01)

(58) Field of Classification Search
CPC .... E04D 2013/0806; E04D 2013/0833; E04D 13/08
See application file for complete search history.

(56) References Cited

U.S. PATENT DOCUMENTS 4,135,540 A * 1/1979 Felsen ..... E04D 13/08 137/875
5,735,085 A * 4/1998 Denooy ..... E04D 13/08 285/283
5,740,757 A * 4/1998 Smeester ..... A01M 13/00 119/51.02
6,240,680 B1 * 6/2001 Estes ..... E04D 13/08 52/16
6,700,098 B1 * 3/2004 Wyatt ..... E04D 13/08 338/315
10,744,510 B1 * 8/2020 Plemmons ..... B02C 25/00
11,371,246 B2 * 6/2022 Ekker ..... E04D 13/08
11,434,639 B2 * 9/2022 Gomez ..... G05D 9/02
11,519,178 B2 * 12/2022 Blevins ..... E04D 13/08
11,686,099 B2 * 6/2023 Gomez ..... E04D 13/08 137/615
2006/0016129 A1 * 1/2006 Riese ..... E04D 13/08 52/16
2017/0081857 A1 * 3/2017 Ellis ..... E04D 13/08
2017/0268797 A1 * 9/2017 Mowris ..... F24H 9/2064
2021/0294932 A1 * 9/2021 Venu ..... G06F 30/12

* cited by examiner

*Primary Examiner* — Adriana Figueroa
(74) *Attorney, Agent, or Firm* — Johnson and Phung; Thomas N. Phung

(57) ABSTRACT

A motorized downspout displacement device including a main housing having an internal fluid passage extending from a first fixed adapter housing to a second displaceable adapter housing with the first fixed adapter housing couplable to a fixed-vertical downspout and the second displaceable adapter housing couplable to a downspout extension, a weather-resistant electric motor moving the second displaceable adapter housing between an extended in-use condition and an out-of-the-way condition, a central processing unit connected to and controlling the operation of the electric motor, a power supply attached to the electric motor, and a control module connected to the central processing unit, the control module transmitting user instructions to the central processing unit.

8 Claims, 3 Drawing Sheets

DOWNSPOUT GUTTER EXTENSION DISPLACEMENT DEVICE

FIELD OF THE INVENTION

This invention relates generally to rain gutters and, more specifically to a downspout drain extension assembly that provides for automatic lift and extension based on the activation of various sensors that are linked to the motorized component of the downspout drain extension assembly.

CROSS-REFERENCE TO RELATED APPLICATIONS

This application claims priority to currently pending U.S. Provisional Application Ser. No. 63/325,335; filed on Mar. 30, 2022; titled DOWNSPOUT GUTTER EXTENSION DISPLACEMENT DEVICE.

STATEMENT REGARDING FEDERALLY SPONSORED RESEARCH OR DEVELOPMENT

None

REFERENCE TO A MICROFICHE APPENDIX

None

BACKGROUND OF THE INVENTION

The use of rain gutters and downspout systems for directing rainwater away from a building structure is well-known in the art. Rain gutter and downspout systems generally employ troughs and extensions of one type or another at the discharge end located at the bottom of a downspout to direct rainwater away from a building structure in a direction lateral to the perpendicular direction position of the gutter vertical downspout. Sometimes it is necessary to move the rainwater across a flower bed or edging as well. One of the problems associated with the aforementioned gutter downspout extension is that they often obstruct the yard area surrounding the building structure, such as interfering with routine yard maintenance work such as mowing around the area near the extensions, especially when not in use.

The use of hinges allows for the displacement of the extension between an extended in-use condition, which is identified by the extension located lateral to the perpendicular direction position of the gutter downspout, and an out-of-the-way condition identified by the extension located in an upright position with a free end of the extension engaging a portion of the gutter downspout is known in the art.

Although the aforementioned hinges work for their intended purpose, one of the problems associated with the aforementioned hinges is the need to physically move each of the downspout extensions from the extended in-use condition to the out-of-the-way condition when doing routine yard maintenance work such as mowing around the area near the downspout extensions.

The present invention is directed to solve the aforementioned problem by providing an electrical or motorized downspout displacement device that automates the movement of the downspout extension between the extended in-use condition and the out-of-the-way condition without the need for a user to physically touch the downspout extension.

SUMMARY OF THE INVENTION

Briefly, the present invention comprises a motorized downspout displacement device that includes a main housing having a fluid passage extending from a first fixed adapter housing to a second displaceable adapter housing. The first fixed adapter housing of the motorized downspout displacement device is couplable to a fixed-vertical downspout and the second displaceable adapter housing is couplable to a downspout extension.

The motorized downspout displacement device also includes a weather-resistant servo motor moving the second displaceable adapter housing and in turn the downspout extension between an extended in-use condition and an out-of-the-way condition, a central processing unit connected to and controlling the operation of the servo motor, and a power supply attached to the servo motor. The motorized downspout displacement device may also include a wireless communication module connected to the central processing unit with the wireless communication module receiving and transmitting user instructions and servo motor operating information between a mobile device and the servo motor.

The motorized downspout displacement device may further include a rain sensor connected to the central processing unit with the rain sensor triggering the electric motor to move the downspout extension between the extended in-use condition and the out-of-the-way condition, the rain sensor located in a spaced condition from the main housing.

The present invention may also comprise a motorized downspout displacement device that includes a weather-resistant electric motor having a first motor housing having a joint arm and a second motor housing having a joint arm with the first motor housing attached to a fixed vertical downspout proximal to an end of the fixed vertical downspout and the second motor housing attached to a downspout extension proximal to an end of the downspout extension.

In a working condition, the joint arm of the first motor housing is connected to the joint arm of the second motor housing to enable the electric motor to move the downspout extension between an extended in-use condition that provides an internal fluid passage from the fixed vertical downspout to the downspout extension and an out-of-the-way condition.

The motorized downspout displacement device also includes a central processing unit connected to and controlling the operation of the electric motor, a power supply attached to the electric motor, and a control module connected to the central processing unit, the control module transmitting user instructions to the central processing unit.

DESCRIPTION OF THE PREFERRED EMBODIMENT

Figure 1:
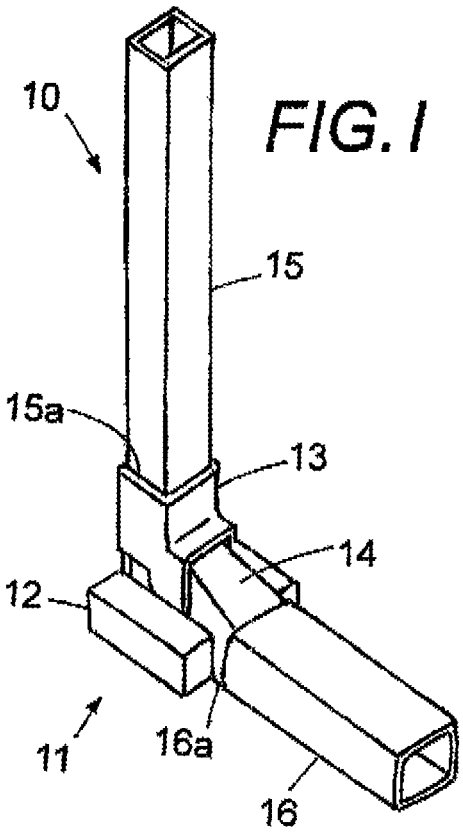
FIG. 1 is a perspective view showing an embodiment of a motorized downspout displacement assembly of the present invention.

The general purpose of the present invention, which will be described subsequently in greater detail, is to provide a downspout drain extension assembly that provides for automatic lift and extension based on the activation of various sensors that are linked to the motorized component of the downspout drain extension assembly.

There have thus been outlined the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the disclosing subject matter be regarded as including such equivalent constructions insofar as they do not depart from the spirit and scope of the present invention.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

In addition, the accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of any potential claims.

In general, the motorized downspout displacement assembly of the present invention is designed to automate the rain gutter and downspout systems of building structures. A feature of the motorized downspout displacement assembly is that the motorized downspout displacement assembly may be controlled in numerous ways including but not limited to the activation of various sensors that are linked to the downspout drain extension assembly.

An example of a setup includes lifted downspout extensions at idle being held up by a rotary actuator or linear actuator such as a servo motor, that allows for precise control of angular or linear position, velocity, and acceleration, and will lower when it rains such as by the activation or triggering by various sensors a rain. The sensitivity of the trigger sensors may be adjustable by a variety of means including but not limited to the coding or physical placement or relocation of the sensor, depending on how sensitive the user wishes the sensor to be.

Figure 2:
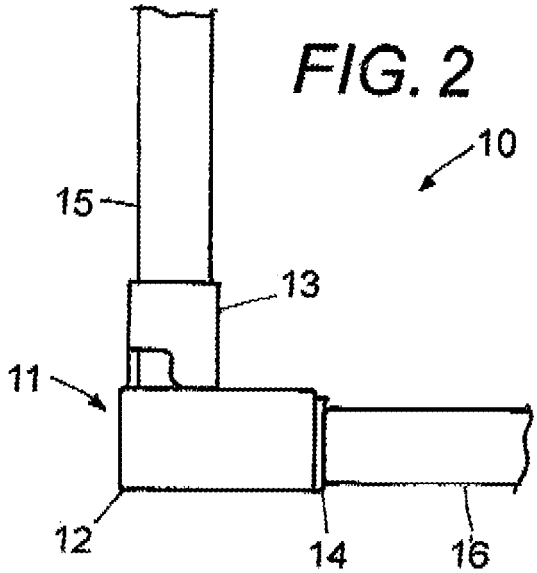
FIG. 2 is a side view showing the motorized downspout displacement assembly of FIG. 1.

Referring to the drawings, FIG. 1 is a perspective view and FIG. 2 is a side view showing an embodiment of a motorized downspout displacement assembly 10 of the present invention. Motorized downspout displacement assembly 10 generally includes a motorized downspout displacement device 11 having a main housing 12 with an internal fluid passage extending from a first fixed adapter housing 13 to a second displaceable adapter housing 14. The first fixed adapter housing 13 is shown as couplable to an end 15*a* of a fixed-vertical downspout 15 and the second displaceable adapter housing 14 is shown as couplable to an end 16*a* of a downspout extension 16.

Located within main housing 12 is a weather-resistant electric motor 18 (shown in FIG. 5), which functions to move the second displaceable adapter housing 14 and in turn the downspout extension 16 between an extended in-use condition and an out-of-the-way condition. The electric motor may comprise different types of motors such as but not limited to a servo motor.

Figure 3:
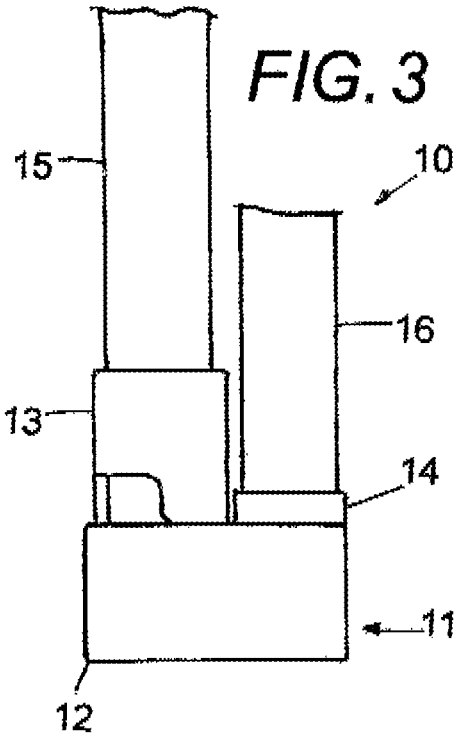
FIG. 3 is a side view showing the motorized downspout displacement assembly of FIG. 2 with a downspout extension in an out-of-the-way condition.

FIG. 2 shows the second displaceable adapter housing 14 and downspout extension 16 in the extended in-use condition, which is identified by the downspout extension 16 located lateral to a ground surface and perpendicular with respect to the position of the fixed-vertical downspout 15. FIG. 3 is a side view showing the second displaceable adapter housing 14 and downspout extension 16 in the out-of-the-way condition identified by the downspout extension 16 located in an upright position distal to the ground surface.

Figure 4:
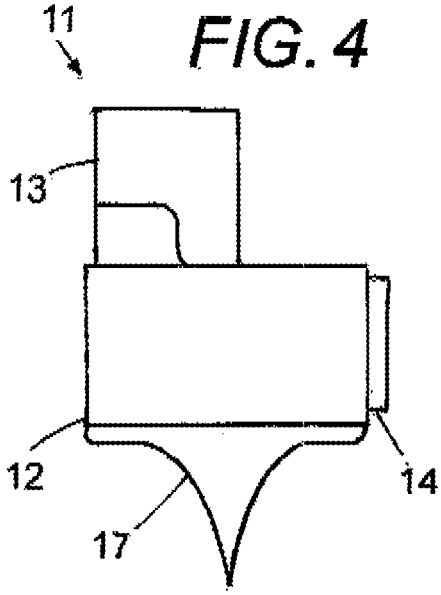
FIG. 4 is a side view showing the motorized downspout displacement device of FIG. 1 supported on a ground stake.

FIG. 4 is a side view showing motorized downspout displacement device 11 supported on an optional ground stake 17 that is preferably secured to a ground surface to prevent the displacement of motorized downspout displacement device 11 while also elevating motorized downspout displacement device 11 above the ground surface and away from rain puddles that may form near fixed-vertical downspout 15.

Figure 5:
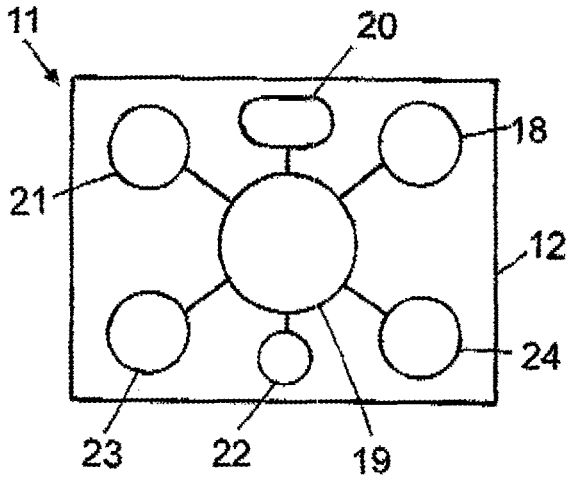
FIG. 5 is a diagram view showing the motorized downspout displacement device.

FIG. 5 is a diagram view showing the motorized downspout displacement device 11, which includes a central processing unit 19 connected to and controlling the operation of the electric motor 18, a power supply 20 attached to the electric motor 18, and a control module 21 connected to the central processing unit 19 with the control module 21 receiving and transmitting user instructions to the central processing unit 19 for operations of the electric motor 18. The power source 20 may comprise a variety of sources including but not limited to a traditional home 120-volt outlet, a 5-volt USB cable needing 2 amps, and a battery cell charged by a solar panel.

The control module 21 or the CPU 26 may also be hooked up to a weather app and have the motorized downspout displacement device 11 set to lower the downspout extension 16 between the extended in-use condition according to the weather app and the parameters set by the user.

The control module 21 may be directly attached to the main housing to receive and transmit user instructions by tactile input to the central processing unit 19 while the user is located at the control module 21 or a wireless communication module that receives and transmits user instructions and electric motor operating information between a mobile device and the electric motor 18. Motorized downspout displacement device 11 may also include an optional microphone 22 connected to the central processing unit 19 to allow for voice command of user instructions to the electric motor 18.

FIG. 5 also shows the motorized downspout displacement device 11 including an optional water level sensor 23 and an optional gravity switch or gravity sensor 24 each connected to the central processing unit 19 for triggering the electric motor 18 to move the downspout extension 16 between the extended in-use condition and the out-of-the-way condition. The gravity switch or gravity sensor 24 may function to collect water as it comes down the drain spout and when gravity sensor 24 fills enough to pull the sensor 24 down the downspout extension 16 between the extended in-use condition.

The gravity switch or gravity sensor 24 may include a Bottom Switch located preferably at a bottom of a housing of the gravity switch or gravity sensor 24, an Inner Switch, which comprises an inner piece of the switch that may be suspended by springs in the gravity switch or gravity sensor housing and stick out the bottom and attach to a water basin/collector or an absorbent material to collect water weight, lower, and trigger the switch to lower the gutters, and a Top Of Switch, which is the top housing of the gravity switch or gravity sensor.

Figure 6:
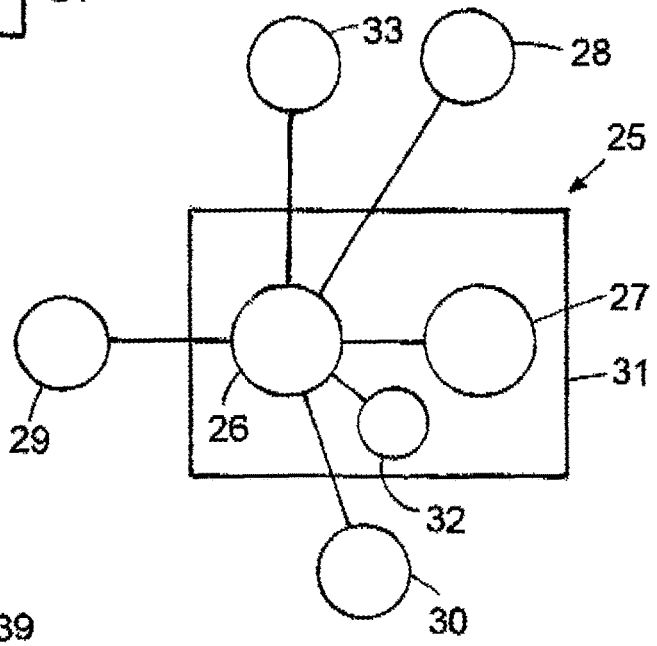
FIG. 6 is a diagram view showing an alternative embodiment of a motorized downspout displacement device.

FIG. 6 is a diagram view showing an alternative embodiment of a motorized downspout displacement device 25, which similar to the motorized downspout displacement device 11 of FIG. 5, includes a main housing 31 supporting a central processing unit 26 connected to and controlling the operation of the electric motor 27, a power supply 28 attached to the electric motor 27, and an optional water level sensor 29 connected to the central processing unit 26 for triggering the electric motor 27 to move a downspout extension between an extended in-use condition and an out-of-the-way condition.

In regard to water level sensor 23, 29, the water level sensor 23, 29 may be set in a basin of some sort within main housing 12, 31 to allow water to build up and not drop the downspout extension 16 until the water level within the basin reaches a desired level.

Motorized downspout displacement device 25, however, is shown including a rain sensor 30 connected to the central processing unit 26, the rain sensor 30 triggering the electric motor 27 to move the downspout extension between the extended in-use condition and the out-of-the-way condition. Although the rain sensor 30 may be directly attached to the main housing 31, the rain sensor 30 preferably is located in a spaced condition from the main housing 31 such as for example, attached to a building roof, attached to the fixed-vertical downspout, or supported on a ground surface by a ground stake.

Motorized downspout displacement device 25 further includes a wireless control module 32 connected to the central processing unit 26 with the wireless control module 32 receiving and transmitting user instructions and electric motor operating information between a mobile device, the central processing unit 26, and the electric motor 27. It is noted that the mobile device may include but is not limited to a cellular phone, a PDA such as an iPad® or tablet, a smartwatch, or a computer.

Motorized downspout displacement device 25 also includes a Near-field communication module 33 in proximity communication with a Near-field communication tag. The proximity communication between the Near-field communication module and the Near-field communication tag is defined as a short-range communication between the two devices wherein for example, the downspout extension 16 is initially in the extended in-use condition until the Near-field communication tag such as in the form of tag on a keychain or a mobile telephone comes within the communication range of the Near-field communication module to trigger the electric motor to move the downspout extension 16 from the extended in-use condition to the out-of-the-way condition. Upon the Near-field communication tag moving away or outside the communication range of the Near-field communication module, the electric motor is then triggered to move the downspout extension 16 from the out-of-the-way condition back to the extended in-use condition.

Figure 7:
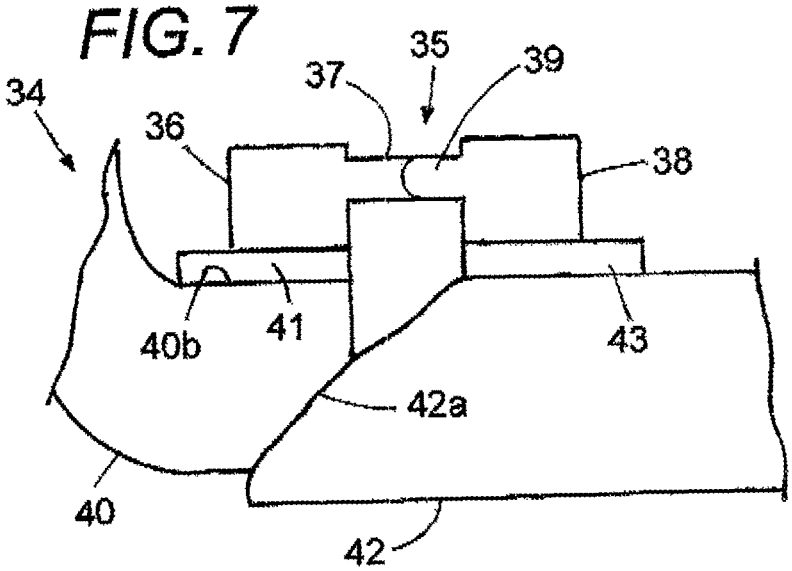
FIG. 7 is a side view showing an alternative embodiment of a motorized downspout displacement device in an extended in-use condition.
Figure 8:
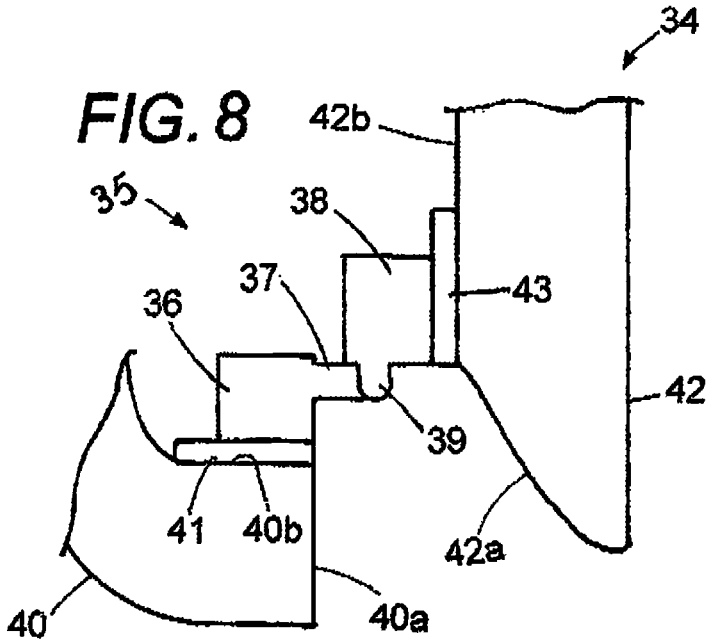
FIG. 8 is a side view showing the motorized downspout displacement device of FIG. 7 in an out-of-the-way condition.

Referring to FIGS. 7 and 8, FIG. 7 is a side view showing an alternative embodiment of a motorized downspout displacement device 34 of the present invention in an extended in-use condition and FIG. 8 is a side view showing motorized downspout displacement device 34 in an out-of-the-way condition. Motorized downspout displacement device 34 includes a gutter elbow embodiment in which an entire elbow of a gutter downspout system is replaced with a custom electronic one.

Motorized downspout displacement device 34 generally includes a weather-resistant electric motor 35 having a first motor housing 36 with a joint arm 37 and a second motor housing 38 with a joint arm 39. The first motor housing 36 is shown attached either directly to a fixed vertical downspout 40 proximal to an end 40*a* of the fixed vertical downspout 40 or through the use of a first motor mount 41 and the second motor housing 38 is attached either directly to a downspout extension 42 proximal to an end 42*a* of the downspout extension 42 or through the use of a second motor mount 43.

In the assembled form the joint arm 37 of the first motor housing 36 is connected to the joint arm 39 of the second motor housing 38 to enable the electric motor 35 to move the downspout extension 42 between the extended in-use condition that provides a fluid passage from the fixed vertical downspout 40 to the downspout extension 42 and the out-of-the-way condition.

Motorized downspout displacement device 34 also includes a central processing unit 18, 26 connected to and controlling the operation of the electric motor 18, 27, a power supply 20, 28 attached to the electric motor 18, 27, and a control module such as a wireless communication module 32 connected to the central processing unit 18, 26 for receiving and transmitting user instructions and electric motor operating information between a mobile device, the central processing unit 19, 26 and the electric motor 18, 27.

The mobile device may include a mobile application allowing for voice command of user instructions to the electric motor 18, 27.

The motorized downspout displacement device 34 may further include a rain sensor 30 connected to the central processing unit 18, 26 and function to trigger the electric motor to move the downspout extension between an extended in-use condition and an out-of-the-way condition.

Figure 9:
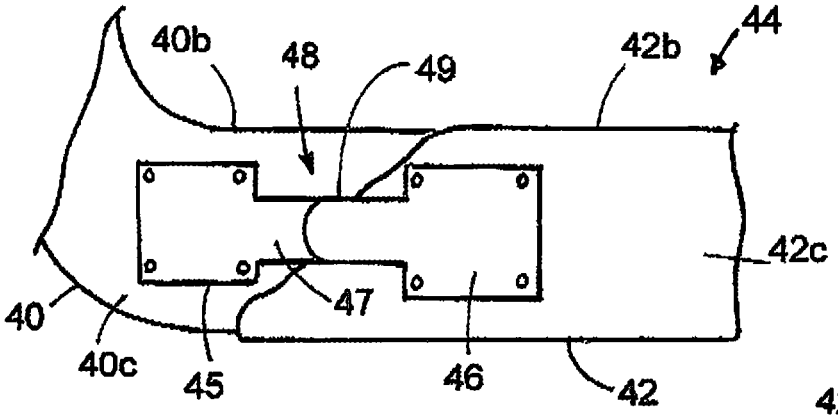
FIG. 9 is a side view showing an alternative embodiment of a motorized downspout displacement device in an extended in-use condition.
Figure 10:
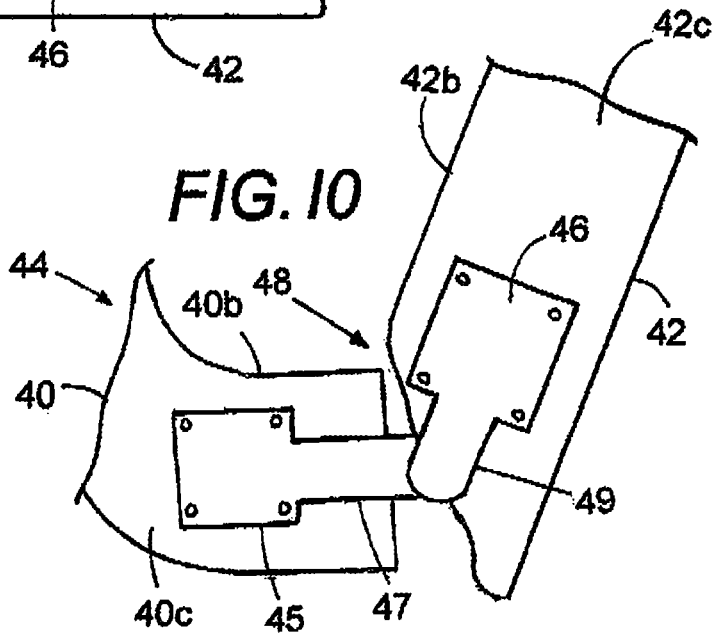
FIG. 10 is a side view showing the motorized downspout displacement device of FIG. 9 in an out-of-the-way condition.

Referring to FIGS. 9 and 10, FIG. 9 is a side view showing an alternative embodiment of a motorized downspout displacement device 44 of the present invention in an extended in-use condition and FIG. 10 is a side view showing motorized downspout displacement device 34 in an out-of-the-way condition.

Motorized downspout displacement device 44 includes similar general components to the motorized downspout displacement device 34 of FIGS. 7 and 8. However, unlike motorized downspout displacement device 34 which shows the first motor housing 36 mounted to a top side 40*b* of the downspout extension 40 and the second motor housing 38 mounted to a top side 42*b* of the downspout extension 42, motorized downspout displacement device 44 includes an electric motor 48 having a first motor housing 45 mounted to either a left or right side 40*c* of the fixed vertical downspout 40 and a second motor housing 46 mounted to a corresponding left or right side of the downspout extension 42.

Similar to the motorized downspout displacement device 34 of FIGS. 7 and 8, in the assembled form of motorized downspout displacement device 44, a joint arm 47 of the first motor housing 45 is connected to a joint arm 49 of the second motor housing 46 to enable the electric motor 48 to move the downspout extension 42 between the extended in-use condition that provides a fluid passage from the fixed vertical downspout 40 to the downspout extension 42 and the out-of-the-way condition.

Alternative embodiments of the present invention may include a downspout drain extension assembly including various types of accessories including but not limited to a Top Mounted Version that includes a Door Panel for sealing off the enclosure with the hole located in a corner functioning for wire access and may be relocated if desired. The peg on the Door Panel is to fit in the support arm and pivot. A Drop Spacer may be used for lowering the gutter to get more angles in the pivot or reaching gutters further away, an Elbow Clamp used to attach to an end of a gutter elbow.

The downspout drain extension assembly may also include a Motor Housing slidable onto a downspout arm that functions to remove water away from the building structure, a Sensor Clip that functions as a holder for the raindrop sensor, or alternatively, the rain sensor may be attached to a stake and be mounted in a ground surface, or secure to a bottom surface of a rain gutter to catch water coming down the spout and trigger the pivot.

A size-specific sleeve may be used to avoid cutting the gutter with the sleeve slidable into the gutter extension used for getting the water away from the house. A Final Motor Housing may then be used to clamp onto the sleeve. The sleeve may be made of various types of polymer plastic or aluminum to fit all gutter sizes and may be easily cut to specific lengths.

The above embodiment may also include an optionally separated housing similar to the motor housing with a part on a top side being similar to a Door Panel. The main difference may be that the motor and electronics are separated for more weather protection.

An alternative embodiment of the present invention may comprise a servo motor located between two housing units to make a joint similar to the motorized downspout displacement device 34 shown in FIGS. 7-10. Computer boards may be in a housing that has cords coming out of it.

The servo motor may be connected to the computer boards through the inside of a housing and an outer side of the housing may have wires coming out from the housing for data and power USB purposes and for connecting to the water sensor. The housing may be welded shut and made of aluminum to last and stay weatherproof or include a weather-proof rubber sleeve that covers the motor to help keep that dry and snugly fit onto both housing pieces.

The housing pieces may be slidable onto any building gutter, and the user may run screws through piloted holes to obtain a snug mount. The gutters may be cut to fit just like existing manual hinges readily available in the marketplace. Spacers may be used just in case the gutter needs to slope at a steep angle or in the event more rotation out of the gutter is needed without the gutters hitting things.

All of the above parts including the sensor may be mounted in the same way, by slipping on tight and screwing into a snug fit. Backing pieces may be used to allow for thicker or thinner applications and a more precise fit.

The current computer boards will likely be simplified and produced in qty as the current boards are Arduino for prototypes. The specific type and specifications of the servo motor may be changed to accommodate the size of the gutter which could alter the power supply. An onboard WI-FI system or module may be on certain embodiments of the present invention. The water sensor of the present invention may vary in their size or even become a water level sensor with the current downspout drain extension assembly including a basket to catch water and wait for a certain water level to trigger the water sensor.

The present invention may also include a mobile application used with the present invention to control and monitor the present invention and a "gate key" such as a universal key attachable to various personal items such as a keychain, a bracelet, or a lawn mower that when switched on allows the downspout drain extension assembly to sense when the gate key is in range and move the drain spout extension up to the out-of-the-way condition automatically.

The downspout drain extension assembly may be set up to sense rainwater and lower the drain spout extension to the extended in-use condition automatically when it rains but otherwise maintains the drain spout extension in the up or out-of-the-way condition. The user may instruct Google or the mobile application to raise or lower the gutters and that will override the sensor for the specified time or until you tell it to go back to auto mode. If the sensor gets triggered but something is keeping the gutter up, then you get a notification. Within the mobile application user may also be able to push a button to lift or lower them, see the status of the gutters, calibrate the up and down position angle, adjust the speed, and sensitivity, and turn on or off the gate key feature.

In regards to Side Mounted motorized downspout displacement devices such as motorized downspout displacement device 44, Side Mounted motorized downspout displacement devices generally include a first and second gutter joint pieces that may be used on any setup that has the electric motor mounted on a left or right side of the vertical downspout and downspout extension. The first gutter joint allows a motor arm located inside a housing, and if installed properly, to be used with any angle downspout gutter system. When the electric motor lowers inside the main housing of the Side Mounted motorized downspout displacement devices the electric motor may go the full range but the downspout extension will stop when it reaches its lowest point of gravity to prevent the electric motor from over-cranking and potentially bending the downspout extension or damaging itself. The first gutter joint and the second gutter joint may each also include a cover piece.

In alternative embodiments, the aforementioned embodiment may also include a servo enclosure that may be mounted to a stake and then mounted in a ground surface. The servo enclosure may also be screwed into the side or strapped to the end of a downspout. A side clamp may slide over the downspout and attaches to an elbow with a servo at a drilled hole location.

I claim:

1. A motorized downspout displacement device comprising:

a weather-resistant electric motor having a first motor housing having a joint arm and a second motor housing having a joint arm, said first motor housing attached to a fixed vertical downspout proximal to an end of said fixed vertical downspout and said second motor housing attached to a downspout extension proximal to an end of said downspout extension, said joint arm of said first motor housing connected to said joint arm of said second motor housing to enable said electric motor to move said downspout extension between an extended in-use condition that provides an internal fluid passage from the fixed vertical downspout to the downspout extension and an out-of-the-way condition;

a central processing unit connected to and controlling the operation of said electric motor;

a power supply attached to said electric motor; and a control module connected to said central processing unit, said control module transmitting user instructions to said central processing unit.

2. The motorized downspout displacement device of claim 1 wherein said control module comprises a wireless communication module, said wireless communication module receiving and transmitting user instructions and electric motor operating information between a mobile device and said servo motor.

3. The motorized downspout displacement device of claim 2 including a rain sensor connected to said central processing unit, said rain sensor triggering said electric motor to move said downspout extension between an extended in-use condition and an out-of-the-way condition.

4. The motorized downspout displacement device of claim 3 wherein said rain sensor is located in a spaced condition from said electric motor.

5. The motorized downspout displacement device of claim 4 wherein said electric motor comprises a servo motor.

6. The motorized downspout displacement device of claim 4 wherein said fixed vertical downspout and said downspout extension each includes a top side, a bottom side, a left side and a right side, and said first motor housing is attached to either said left or right side of said fixed vertical downspout and said second motor housing is attached to a corresponding left or right side of said downspout extension.

7. The motorized downspout displacement device of claim 5 wherein said mobile device includes a mobile application allowing for voice command of user instructions to said electric motor.

8. The motorized downspout displacement device of claim 5 wherein said power supply comprises a battery cell charged by a solar panel.

* * * * *